US005690436A

United States Patent [19]

Suzuki et al.

[11] Patent Number: 5,690,436

[45] Date of Patent: Nov. 25, 1997

[54] THERMAL PRINTER

[75] Inventors: Katsutoshi Suzuki; Mitsuo Yoshida; Yuko Sonoda; Hiroo Sonoda, all of Fukushima-ken; Yasuhiko Iwane; Masahiko Mori, both of Iwate-ken, all of Japan

[73] Assignee: Alps Electric Co., Ltd., Tokyo, Japan

[21] Appl. No.: 664,275

[22] Filed: Jun. 11, 1996

[30] Foreign Application Priority Data

Jun. 14, 1995 [JP] Japan ..... 7-171555

[51] Int. Cl.[6] ..... B41J 2/315

[52] U.S. Cl. ..... 400/120.01; 400/120.03; 347/210

[58] Field of Search ..... 400/120.01, 70, 400/76, 61, 120.03; 347/210

[56] References Cited

U.S. PATENT DOCUMENTS

| | | | |
|---|---|---|---|
| 4,879,566 | 11/1989 | Hanabusa | 400/708 |
| 5,064,301 | 11/1991 | Nakamura et al. | 400/120.13 |
| 5,536,092 | 7/1996 | Yamaguchi | 400/231 |

FOREIGN PATENT DOCUMENTS 2-108563 4/1990 Japan .

*Primary Examiner*—John S. Hilten

*Attorney, Agent, or Firm*—Guy W. Shoup; Patrick T. Bever

[57] ABSTRACT

A thermal printer that performs thermal printing by employing a commonly-used thermo-sensitive recording sheet. In the thermal printing, a thermal head starts heating the recording sheet from the back side of a base that covers a recording surface in order to print, so that the recorded information is effectively hidden from view. When the thermal printer performs thermal printing by using a two layer thermo-sensitive recording sheet, high quality images with sharp edges can be reliably recorded. The thermal printer uses two types of thermo-sensitive sheets to perform thermal recording. When the first type of thermo-sensitive recording sheet is used, a heating control device is switched to a reversed or inverted image heating control mode causing the thermal head to start heating the recording sheet from a carrier sheet side of the first type of thermo-sensitive recording sheet that has not yet undergone a change in color to a recording material of the sheet, whereby the recording material undergoes a change in color, resulting in the recording of images with their sides reversed or inverted.

5 Claims, 5 Drawing Sheets

FIG. 4
A B C D E F G
FIG. 5
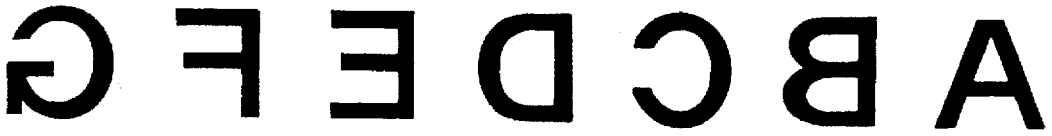
FIG. 6
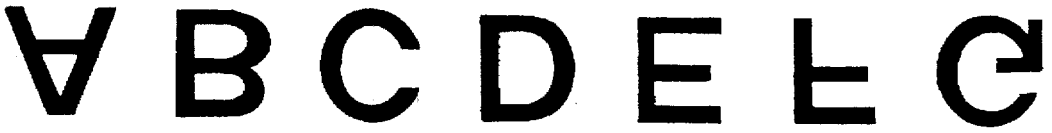

THERMAL PRINTER

BACKGROUND OF THE INVENTION

1. Field of the Invention

The present invention relates to a thermal printer, used for a word processor, facsimile receiver, or the like, that performs image recording such as printing on a thermo-sensitive sheet.

2. Description of the Related Art

The structures of a conventional thermal printer and thermo-sensitive sheets used therein are described with reference to FIGS. 7 to 9. Referring to the figures, a row of gears 8 is provided so as to act between a rotatable platen 1 and a stepping motor 7. When the stepping motor 7 rotates, the platen 1 rotates in the direction of arrow A in FIG. 7 via the row of gears 8.

A carriage 6 having mounted thereto a thermal head 2 is constructed so as to be movable in the axial dimension of the platen 1 by means of a carriage guide 9 and swingable around the carriage guide 9 serving as fulcrum in order to allow the thermal head 2 to contact and separate from the platen 1. The thermal head 2 mounted to the carriage 6 swings down toward the platen 1 along with the carriage 6 and generates heat only when the carriage moves to the right or in the direction of arrow C in FIG. 7.

There are two types of thermo-sensitive recording sheets used in the thermal printer. The first type is illustrated in FIG. 8 and denoted by reference numeral 3. In the structure of the thermo-sensitive recording sheet 3, one side of a carrier sheet 3*a* of the sheet 3 has uniformly coated thereon a recording material 3*b*, being for example composed of leuco, that upon heating changes color as it undergoes a chemical reaction. The recording sheet may be an A4 standard size sheet or a roll sheet that can be of any length along the vertical direction.

The second type, being a two-layer type thermo-sensitive recording sheet, is illustrated in FIG. 9 and denoted by reference numeral 5. In the structure of the thermo-sensitive recording sheet 5, a recording material 5*b*, being for example composed of leuco, is uniformly coated on one side of a carrier sheet 5*a* of the sheet 5, as has been the case for the above-described thermo-sensitive recording sheet 3. In addition to this, an adhesive 5*d* of low viscocity is applied onto the recording material 5*b*, and a protective sheet 5*e* is formed on the adhesive 5*d* with low viscocity. The protective sheet 5*e* is an opaque sheet which covers the information recorded by thermal recording.

More specifically, the structure of the above-described thermo-sensitive recording sheet 5 includes the protective sheet portion 5*e*, bonded by means of the adhesive 5*d*, that covers the recording material 5*b* coated onto the carrier sheet 5*a*. Therefore, when an image is recorded onto the recording material 5*b* by thermal recording, the protective sheet 5*e* on one side of the recording material 5*b* and the carrier sheet 5*a* on the other side of the recording material 5*b* covers the recorded information, making it impossible for anyone to read the information from either side of the thermo-sensitive sheet 5.

The adhesiveness of the adhesive 5*d* used in the thermo-sensitive recording sheet 5 is such as to allow it to be peeled off from the carrier sheet 5*a* by any ordinary person and not to damage the recording material 5*b* coated on the carrier sheet 5*a* when the protective sheet 5*e* is being peeled away from the carrier sheet 5*a*. Upon recording the images onto the thermo-sensitive recording sheet 5 by thermal printing, the protective sheet 5*e* is peeled off from the carrier sheet 5*a* and the carrier sheet 5*a* with the recording material 5*b* is used as printed material.

The thermo-sensitive recording sheet 3 or 5 having the above-described structure is set in a thermal printer and wound around the platen 1 by means of a sheet feed roller (not shown) in order to perform sheet feeding.

The thermo-sensitive sheet 3 or 5 is fed in the direction of arrow B in FIG. 7 while the carrier sheet 3*a* is kept in contact with the platen 1 and the recording material 3*b* is in opposition to the thermal head 2, or while the carrier sheet 5*a* is kept in contact with the platen 1 and the protective sheet 5*e* is in opposition to the thermal head 2.

A description will now be given of a thermal recording method in the case where the thermo-sensitive recording sheet 3 is used, with reference to FIGS. 7 and 8. The thermo-sensitive recording sheet 3 is set in position around the platen 1 such that the recording material 3*b* that changes color due to heating is opposed to the thermal head 2. Here, the carriage 6 and the thermal head 2 waits in order to start printing at the left side of the thermo-sensitive sheet 3 where printing is to be started, with the thermal head 2 being separated from the thermo-sensitive recording sheet 3. Upon generation of a print command from the thermal printer, the thermal head 2 swings down toward the platen 1 in order to press against the recording material 3*b* and press the back side 3*c* of the carrier sheet 3*a* against the platen 1, whereby the thermo-sensitive recording sheet 3 is nipped between the thermal head 2 and the platen 1. In this condition, the thermal head 2 Generates heat by the operation of a heating control means (not shown) that controls the heating of a thermal resistor, and moves to the right in the direction of arrow C in FIG. 7 along with the carriage 6.

Thereafter, in accordance with the print command from the thermal printer, the heat generated by the thermal head 2 causes the recording material 3*b* to undergo a change in color, resulting in recording of images by printing or the like.

Upon completion of a line of printing carrier sheet on the print command from the thermal printer, the thermal head 2 swings upward and away from the platen 1. With the head 2 swung upward, the carriage 6 and the thermal head 2 moves toward the left and returns to the printing start position. In addition, the platen 1 is rotated in the direction of arrow A by one line via the row of gears 8 as the stepping motor 7 rotates, whereby the thermo-sensitive sheet 3 is fed by an amount corresponding to one line. The second line of recording onto the thermo-sensitive sheet 3 by thermal recording is performed when the thermal head 2 swings down toward the platen 1 again and the same operations to those described above are carried out carrier sheet on the print command from the thermal printer.

The images recorded in such a manner are normal images as illustrated in FIG. 4. In the thermal recording of normal images, the heating control means that controls the heating of the thermal head 2 causes a thermal resistor of the thermal head 2 to be selectively heated by supplying current thereto on the print command from the thermal printer.

Such a thermal printing method has the disadvantage that anyone, in addition to the operator, who happens to be in the vicinity of the thermal printer can easily read the recorded information. This is because this thermal recording method is one in which the thermal head 2 presses against the recording material 3*b* forming the outer portion of the sheet 3 in order to record normal images such as characters or figures thereon, so that the recorded information can be easily read from the recording material 3b side which is the front side of the thermo-sensitive recording sheet 3.

In addition, the thermo-sensitive sheet 3 is discharged onto the discharge tray (not shown) with its recording material 3a side faced upward, so that anyone, in addition to the operator, who happens to be in the vicinity of the thermal printer can easily read the recorded information even after recording.

A description will now be given of the thermal recording method in the case where the two-layer type thermo-sensitive recording sheet 5 is used, with reference to FIGS. 7 and 9. Referring to the figures, the thermo-sensitive recording sheet 5 is set in position around the platen 1 such that the front side 5f of the protective sheet 5e is opposed to the thermal head 2.

As in the above-described conventional method, a print command from the thermal printer causes the thermal head 2 to swing downward toward the platen 1 in order to press against the front side 5f of the protective sheet 5e of the thermo-sensitive recording sheet 5 and press the back side 5c of the carrier sheet 5a against the platen 1, whereby the thermo-sensitive recording sheet 5 is nipped between the thermal head 2 and the platen 1.

When the head 2 and the platen 1 nip the thermo-sensitive sheet 5, the thermal head 2 generates heat by the operation of the heating control means that controls the heating of a thermal resistor and moves to the right with the carriage 6, resulting in recording of images onto the recording material 5b of the thermo-sensitive recording sheet 5. The images are recorded in normal form when a thermal resistor of the thermal head 2 is selectively heated due to the supply of current thereto by the operation of the heating control means that controls the heating of the thermal head carrier sheet on the print command from the thermal printer. The heat of the selectively heated thermal resistor is transmitted to the protective sheet 5a and then to the adhesive 5d, as a result of which the recording material 5b coated on the carrier sheet 5a changes color, so that normal images are recorded thereon.

Thereafter, the same operations to those described in the above-described conventional method are performed, so that the carriage 6 returns to its original position and the two-layer thermo-sensitive recording sheet 5 is fed in order to successively perform thermal recording.

The images recorded in such a manner cannot be seen from the outside because of the protective sheet 5e, but when they are recorded in normal form as illustrated in FIG. 4 and the protective sheet 5e is peeled away from the carrier sheet 5a, it can easily be read by anyone.

However, in the conventional thermal printer having the above-described construction and using thermo-sensitive sheet 3 of FIG. 8 with the above-described structure, the front side of the recording material 3b of the thermo-sensitive recording sheet 3 is used for recording an image, so that anyone, in addition to the operator, who happens to be in the vicinity of the thermal printer can easily read the information being recorded.

In addition, the thermo-sensitive recording sheet 3 is discharged onto the discharge tray (not shown) with the recording material 3a faced upward, so that anyone in addition to the operator who happens to be in the vicinity of the thermal printer can easily read the recorded information even after thermal recording, resulting in leakage of private or secret information that the operator does not want to reveal.

The use of the two-layer thermo-sensitive recording sheet 5 of FIG. 9 is effective in hiding the recorded information from anyone who happens to be in the vicinity of the thermal printer because the adhesive 5 covers the recording material 5b. Some of the heat generated from the thermal resistor of the thermal head 2 is lost by radiation during the time in which it is transmitted through the protective sheet 5e and the adhesive 5d, resulting in a temperature drop, so that enough heat is not transmitted to the recording material 5b at the front side of the carrier sheet 5a to allow the member 5b to change color completely. For this reason, the image recorded by thermal recording on the recording material 5b of the thermo-sensitive sheet 5 appears blurred at the edges, thus giving rise to the problem that a high quality, sharp image cannot be recorded.

The quality of the image to be recorded onto the above-described two-layer thermo-sensitive recording sheet 5 can be improved by increasing the heating temperature of the thermal resistor of the thermal head 2. However, a higher heating temperature of the thermal head 2 reduces the life of the thermal resistor and increases the amount of power consumed so that energy cannot be saved.

SUMMARY OF THE INVENTION

To overcome the above-described problems, according to one aspect of the present invention, there is provided a thermal printer of the type using a thermo-sensitive recording sheet prepared by applying a recording material that changes color when heated to one side of a carrier sheet, with or without an opaque protective sheet bonded thereon. The thermal printer comprises: a thermal head that generates heat in order to perform thermal recording on the thermo-sensitive recording sheet; a rotatable platen that nips the thermo-sensitive recording sheet with the thermal head; and a carriage having mounted thereto the thermal head and movable along the platen. In the thermal printer, the thermal head is pressed against the back side of the carrier sheet in order to perform thermal recording on the thermo-sensitive recording sheet, with the back side of the carrier sheet being the side of the carrier sheet not coated with the recording material. According to one specific form of one aspect of the present invention, there is provided a thermal printer which may further comprise heat-generation control means for controlling the heat generation of the thermal head in order to perform thermal recording of a normal image, an image whose left and right sides are reversed, or an image whose top and bottom sides are inverted.

To overcome the above-described problems, according to another aspect of the present invention, there is provided a thermal printer of the type using a thermo-sensitive recording sheet prepared by applying a recording material to one side of a carrier sheet, with or without an opaque protective sheet bonded thereon. The thermal printer comprises: a thermal head that generates heat in order to perform thermal recording on the thermo-sensitive recording sheet; a rotatable platen that nips the thermo-sensitive recording sheet with the thermal head; a carriage having mounted thereto the thermal head and movable along the platen; heat-generation control means for controlling the heat generation of the thermal head in order to perform thermal recording of a normal image, an image whose left and right sides are reversed, or an image whose top and bottom sides are inverted on the thermo-sensitive sheet; and switching means for switching the heating control mode to normal image heating control mode, horizontally-reversed image heating control mode in which an image is recorded with its left and right sides reversed, or vertically-inverted image heating control mode in which an image is recorded with its top and bottom sides inverted. In the thermal printer, the thermal head presses against the side of the thermo-sensitive recording sheet coated with the recording material, the protective sheet side of the thermo-sensitive carrier sheet, or the back side of the carrier sheet in order to perform thermal recording of a normal image, an image whose left and right sides are reversed, or an image whose top and bottom sides are inverted.

According to one specific form of another aspect of the present invention, there is provided a thermal printer which may comprise automatic switching means for automatically switching the heat-generation control means of the thermal head by automatically identifying the recording material side of the thermo-sensitive recording sheet, the protective sheet side of the thermo-sensitive recording sheet, or the back side of the carrier sheet, with the back side of the carrier sheet being the side of the carrier sheet not coated with the recording material.

According to one aspect and one specific form of one aspect of the present invention, thermal recording is performed from the back side of the carrier sheet of either the above-described first type of thermo-sensitive sheet or the second type of (two layer) thermo-sensitive sheet, thus making it difficult for anyone who happens to be in the vicinity of the thermal printer to read the information being recorded onto either of the sheet types. In addition, the images recorded onto the two-layer type thermo-sensitive recording sheet will be of high quality.

According to another aspect of the present invention, the heating control means of the thermal head can be switched, carrier sheet on whether the thermal head is in opposition to the recording material coated on the first type of thermo-sensitive recording sheet or the back side of carrier sheet of the first type of thermo-sensitive recording sheet, or the protective sheet of the second type of (two layer) thermo-sensitive recording sheet or the back side of the carrier sheet of the second type of (two layer) thermo-sensitive sheet.

According to one specific form of another aspect of the present invention, it is possible to automatically detect the back side or front side of the first type of thermo-sensitive recording sheet or the back side or front side of the second type of (two layer) thermo-sensitive recording sheet in order to automatically switch the heating control means of the thermal head.

BRIEF DESCRIPTION OF THE DRAWINGS

FIG. 4 illustrates normal images recorded by the thermal printer of the present invention and a conventional thermal printer.

FIG. 5 illustrates images recorded by the thermal printer of the present invention in heating a control mode in which the left and right sides thereof are reversed.

FIG. 6 illustrates images recorded by the thermal printer of the present invention in a heating control mode in which the top and bottom thereof are inverted.

DESCRIPTION OF PREFERRED EMBODIMENTS

Figure 1:
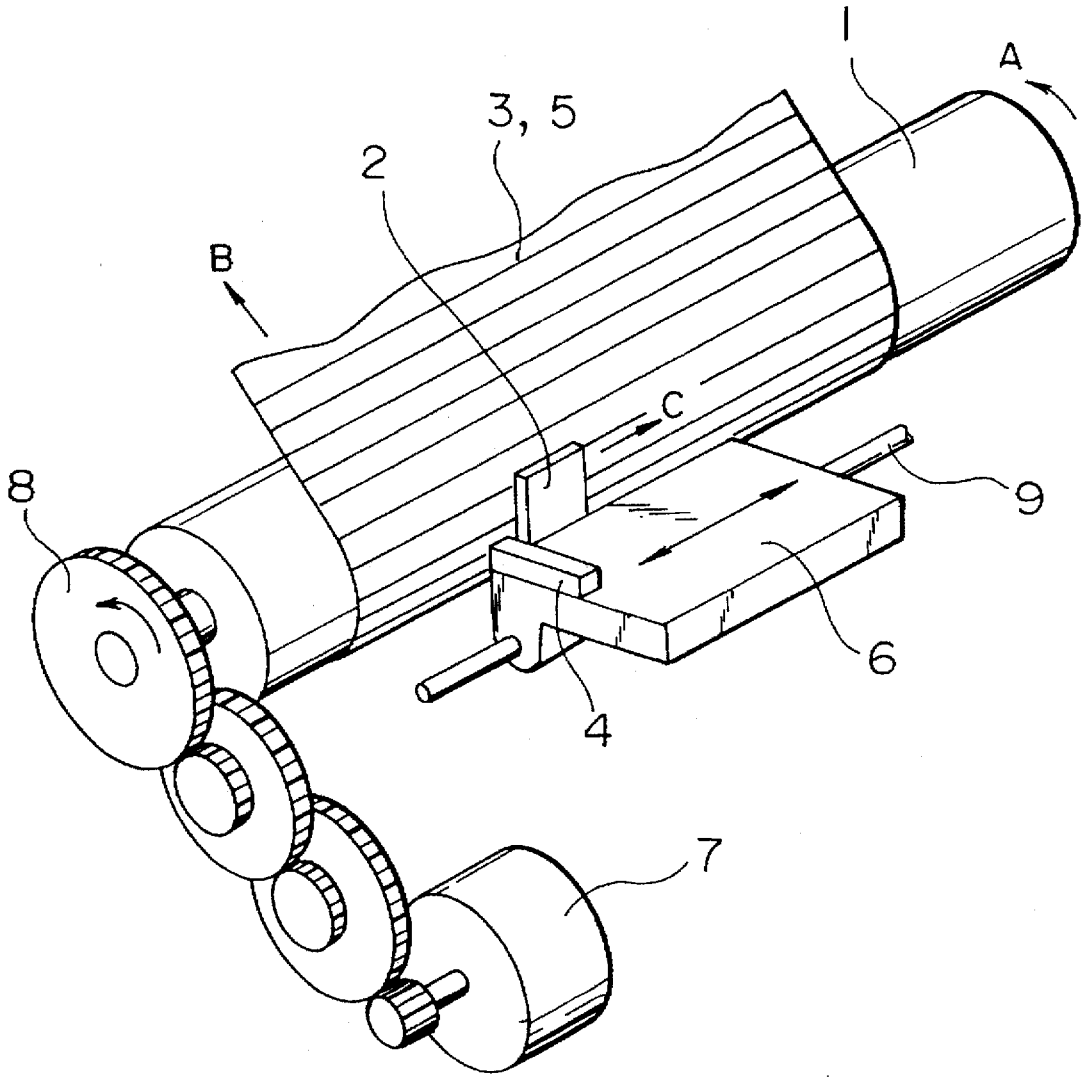
FIG. 1 is a schematic perspective view showing the relationship between sheet feeding and operation of a thermal head of a thermal printer in accordance with the present invention.
Figure 2:
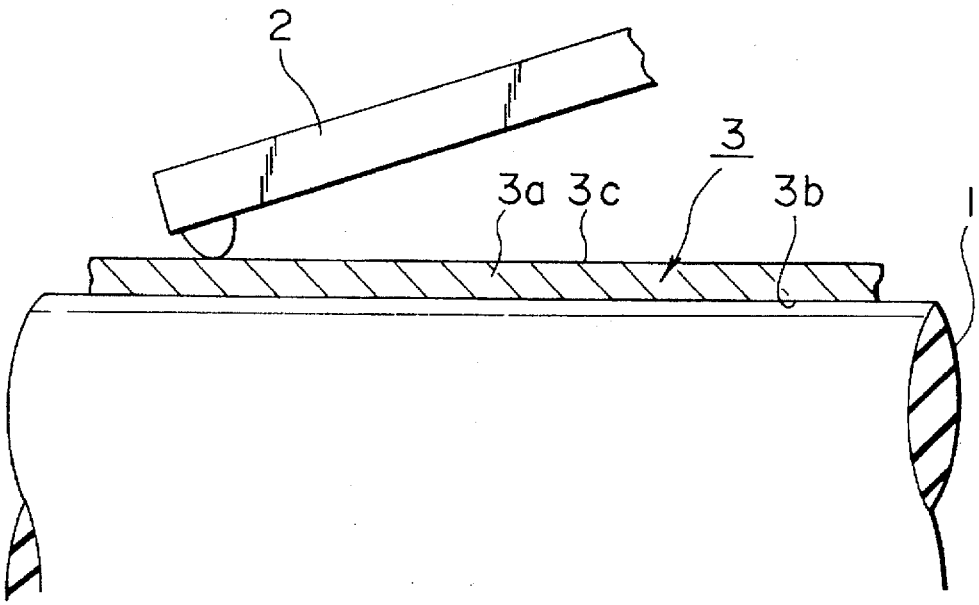
FIG. 2 is illustrative of thermal recording carried out by the thermal printer of the present invention in the case where a first type of thermo-sensitive recording sheet is used.
Figure 3:
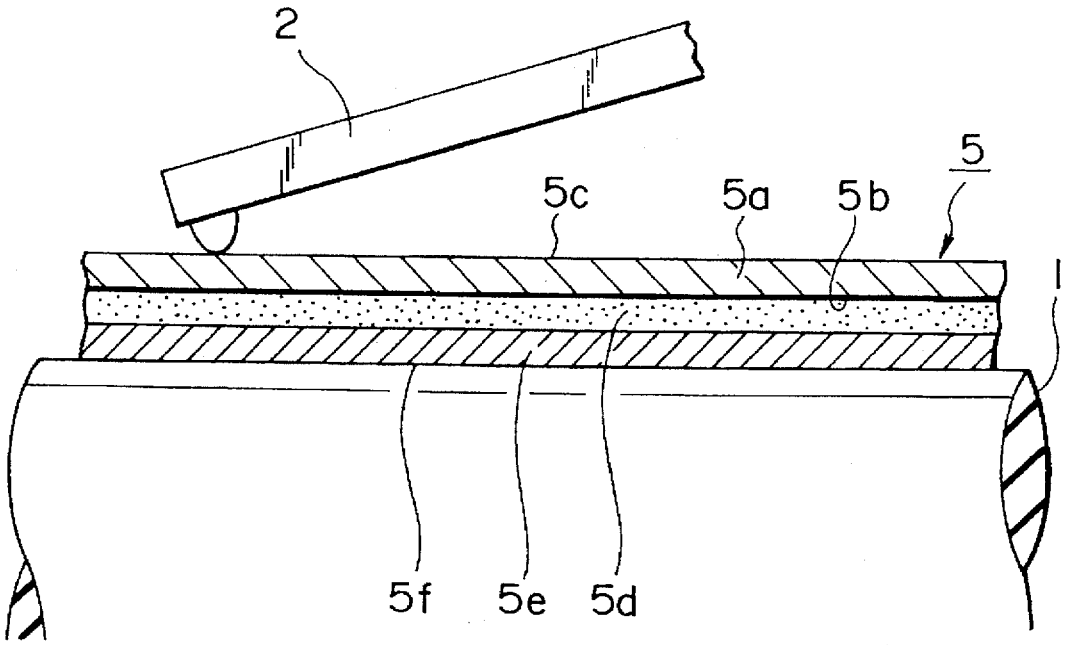
FIG. 3 is illustrative of thermal recording carried out by the thermal printer of the present invention in the case where a second type of (two layer) thermo-sensitive recording sheet is used.

FIGS. 1 to 6 are drawings used for describing the present invention. FIG. 1 is a schematic perspective view of a thermal printer in accordance with the present invention; FIG. 2 is illustrative of thermal recording performed by the thermal printer of the present invention in the case where a first type of thermo-sensitive recording sheet is used; FIG. 3 is illustrative of thermal recording performed by the thermal printer of the present invention in the case where a second type of (two layer) thermo-sensitive recording sheet is used; FIG. 5 shows images formed by thermal recording in which the left and right sides thereof are reversed; FIG. 6 shows images formed by thermal recording in which the top and bottom sides thereof are inverted.

Figure 7:
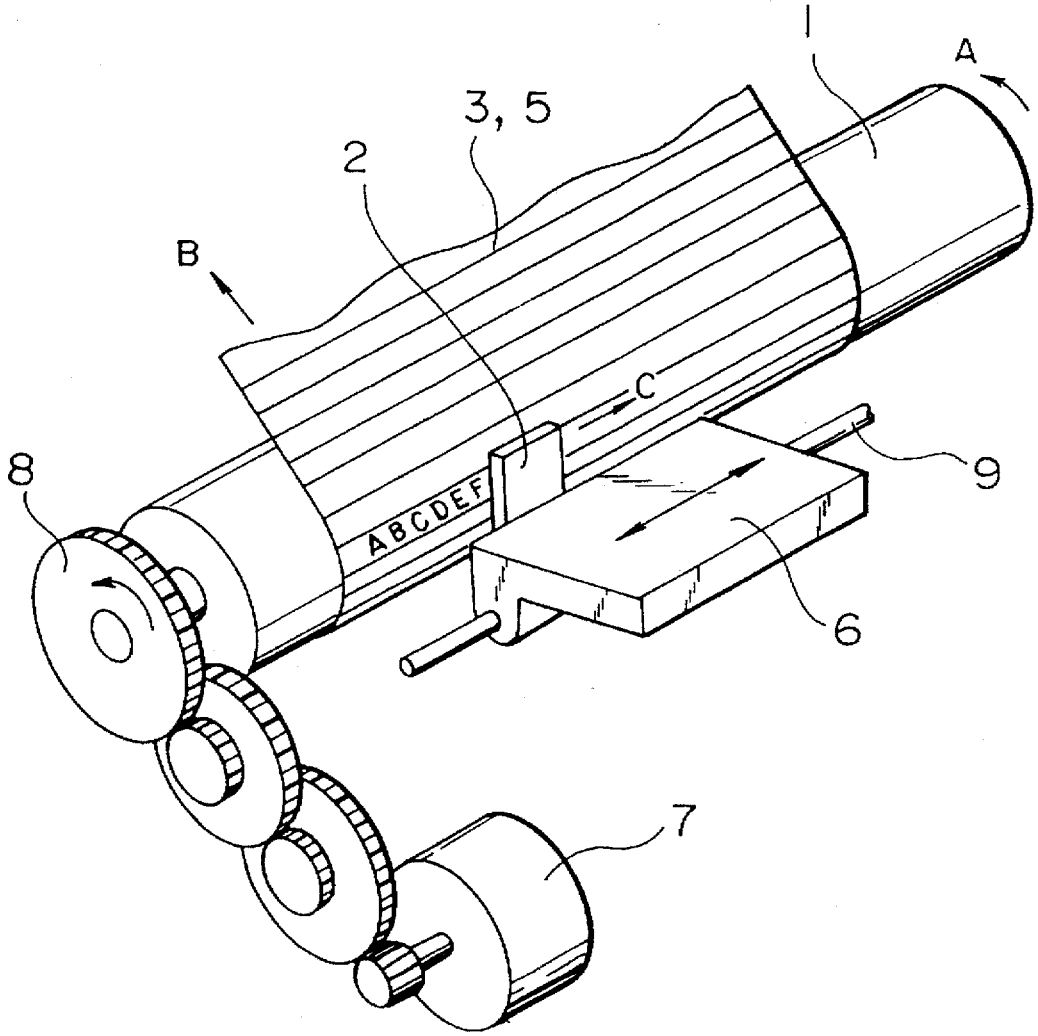
FIG. 7 is a schematic perspective view showing the relationship between sheet feeding and operation of a thermal head of a conventional thermal printer.

Referring to FIG. 1 illustrating an embodiment of the thermal printer in accordance with the present invention, the construction including platen 1, thermal head 2, carriage 6, stepping motor 7, and a row of gears 8, and the operation thereof are essentially the same as the construction and operation of the conventional thermal printer illustrated in FIG. 7. Therefore, they will not be described below.

Figure 8:
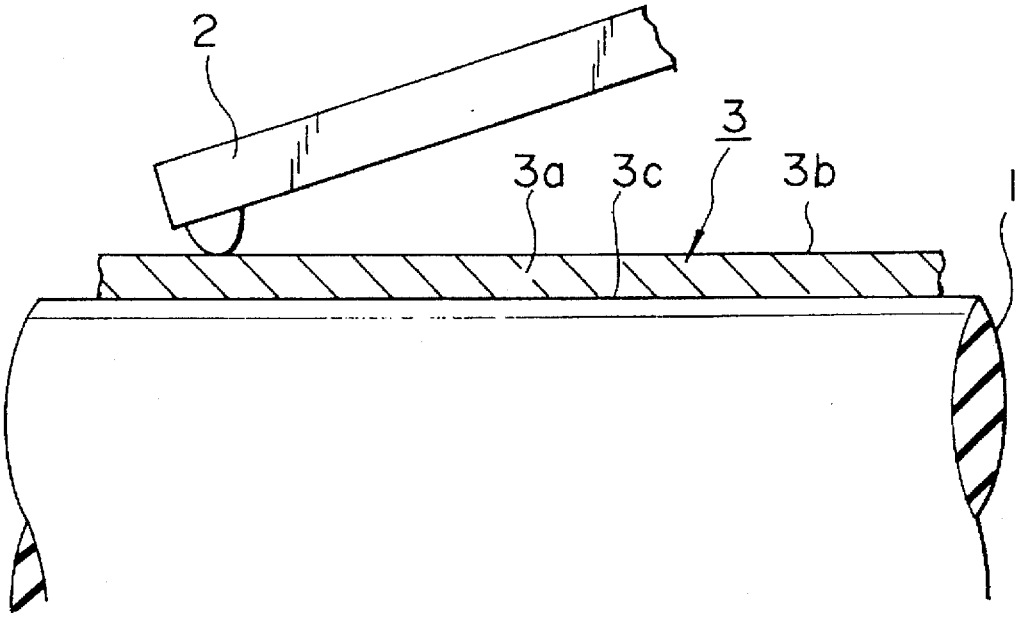
FIG. 8 is illustrative of thermal recording carried out by the conventional thermal printer in the case where the first type of thermo-sensitive recording sheet is used.
Figure 9:
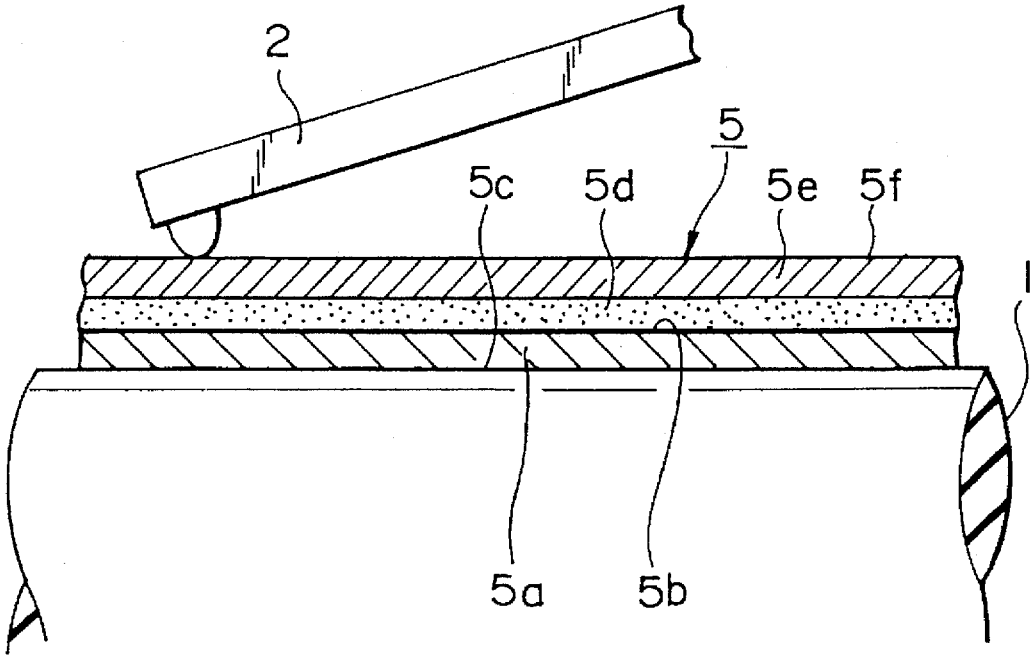
FIG. 9 is illustrative of thermal recording carried out by the conventional thermal printer in the case where the second type of (two layer) thermo-sensitive recording sheet is used.

In addition, the thermo-sensitive recording sheet 3 and the two-layer type thermo-sensitive recording sheet 5 used in the thermal printer of the present invention are essentially structured in the same way as the thermo-sensitive recording sheet 3 and the two-layer type thermo-sensitive recording sheet 5 of FIGS. 8 and 9, respectively, used in the conventional thermal printer. Therefore, they will not be described below.

As illustrated in FIG. 1, a switching means 4, composed of a sensor or the like, is mounted to a carriage 6. The switching means 4 is constructed so as to sense the roughness of the surface of the recording material **3*b* or the carrier sheet 3*a* of the thermo-sensitive recording sheet 3, or the protective sheet 5*e* or carrier sheet 5*a* of the thermo-sensitive sheet 5 and to switch a heating control means (not shown) which controls the heating of the thermal head 2** in order to select the control mode to set it in that mode. The control modes are normal heating control mode in which a normal image is recorded, a horizontally reversed image heating control mode in which the left and right sides of the image are reversed; and vertically inverted image heating control mode in which the top and bottom of the image are inverted.

A description will now be given of a first thermal recording method in accordance with the present invention in which the first type of thermo-sensitive recording sheet 3 is used, with reference to FIGS. 1 to 6. In the first recording method which may also use the second type of sheet, when the thermo-sensitive recording sheet 3 (or 5) is wound around the platen 1 by means of a sheet feed roller (not shown) so that the back side **3*c* of the carrier sheet 3*a* (or the back side 5*c* of the carrier sheet 5*a*) contacts the outer peripheral surface of the platen 1, the recording material 3*b***

(or the protective sheet 5*e*) opposes the thermal head 2 as well as the switching means 4 that selectively switches the heating control means of the thermal head 2 to the normal heating control mode. Thereafter, a print command from the thermal printer causes images to be recorded onto the thermo-sensitive recording sheet 3 (or 5) in essentially the same manner as illustrated in FIG. 8 or 9, after which the recording sheet is discharged.

In a second recording method, when the thermo-sensitive recording sheet 3 is wound around the platen 1 by means of sheet feed roller so that the recording material 3*b* contacts the outer peripheral surface of the platen 1, the recording material 3*b* contacts the platen 1 and the back side 3*c* of the carrier sheet 3*a* is in opposition to the thermal head 2 and the switching means 4. Here, the switching means 4 selectively switches the heating control means of the thermal head 2 to horizontally reversed image heating control mode where the left and right sides of the image are reversed.

Thereafter, a print command from the thermal printer causes the thermal head 2 to rotate downward, contact the back side 3*c* of the carrier sheet 3*a*, and generate heat. The heating causes the recording material 3*b* formed on the opposite side of the carrier sheet 3*a* to change its color. When a line of images is being recorded in this case, the thermal head 2 moves in the direction of arrow C as shown in FIG. 1 while processing means (not shown) in the thermal printer successively records images with their left and right sides reversed from the actual last image of a line. After a line of recording is complete, the thermal head 2 moves upward, and returns to its original (home) position, and sheet feeding by one line is performed, as in the conventional thermal printer. Further image recording is performed when the above-described operations are repeated. Upon recording a page of images, the recording sheet is discharged with the recording material 3*b* at the bottom and the back side 3*c* of the carrier sheet 3*a* at the top, as has been the case in the conventional thermal printer.

Accordingly, when image recording is performed by the thermal head 2 from the carrier sheet 3*a* side, the image recording surface, during printing or after sheet discharge, is hidden by the carrier sheet 3*a*, making it impossible for anyone who happens to be in the vicinity of the thermal printer to read the information on the image recording surface.

The images illustrated in FIG. 5 have their left and right sides reversed as viewed from the carrier sheet 3*a* side. Accordingly, when the thermo-sensitive recording sheet 3 is turned over so that left and right sides of the sheet 3 are reversed and these images are read from the recording material 3*b* that is now at the front side, they appear as normal images as illustrated in FIG. 4.

In a third recording method, the thermal printer is constructed such that the switching means 4 causes the heating control means to be switched to the normal heating control mode or the vertically inverted image heating control mode in which the images produced by thermal recording have their top and bottom sides inverted. When the recording material 3*b* of the thermo-sensitive recording sheet 3 is disposed so as to oppose the thermal head 2 and the switching means 4, the switching means 4 causes the heating control means to be switched to the normal heating control mode in which normal images are recorded and similar operations to those in the above-described first recording method are performed, so that descriptions thereof will be omitted.

When the thermo-sensitive sheet 3 is wound around the platen 1 by means of a sheet feed roller such that the recording material 3*b* contacts the outer peripheral face of the platen 1, the carrier sheet 3*a* is in opposition to the thermal head 2 as shown in FIG. 2, and the switching means 4 selectively switches the heating control means to the vertically inverted image heating control mode in order to record images with their top and bottom sides inverted.

Thereafter, a print command from the thermal printer causes the thermal head 2 to move downward, contact the carrier sheet 3*a*, and generate heat. The heating causes the recording material 3*b* formed on the opposite side of the carrier sheet 3*a* to change color. When a page of images is being recorded in this case, the thermal head 2 travels along with the carriage 6 in the direction of arrow C as illustrated in FIG. 1 while an image process means (not shown) successively records images in such a manner that the top and bottom sides of the images are inverted starting from the images of the actual last line of the page. Upon completion of the image recording of the images of the last line of the page, similar operations to those described above are performed in order to record the images of the actual next-to-last line of the page.

Such operations are repeated so that eventually the thermo-sensitive recording sheet 3 is discharged after the image to be actually read first has been recorded.

As in the previous case, the recorded image is hidden by the carrier sheet 3*a*, during printing or discharge, thus making it impossible to read the recorded image.

When images are recorded with their top and bottom sides inverted, the images appear upside down as illustrated in FIG. 6 as viewed from the carrier sheet 3*a* side. In such a case, when the discharged thermo-sensitive recording sheet 3 is turned over so as to invert the top and bottom of the sheet 3, the images appear in normal form as illustrated in FIG. 4 as viewed from the recording material 3*b* side.

A description will now be given of a thermal image recording method in another embodiment of the present invention in the case where a two-layer type thermo-sensitive sheet 5 is employed. This method called a fourth recording method will be described with reference to FIGS. 1, 3, 4, 5, and 6. Referring to the figures, when the thermo-sensitive sheet 5 is wound around the platen 1 by means of a sheet feed roller (not shown) such that the protective sheet 5*e* contacts the outer peripheral surface of the platen 1, the front side 5*f* of the protective sheet 5*e* is in contact with the platen i and the back side 5*c* of the carrier sheet 5*a* is in opposition to the thermal head 2 and the switching means 4. The switching means 4 selectively switches the heating control means of the thermal head 2 to the horizontally reversed image heating control mode where the images are recorded with their left and right sides reversed.

Thereafter, upon generation of a print command from the thermal printer, the thermal head 2 swings downward toward the platen 1, comes into contact with the back side 5*c* of the carrier sheet 5*a*, and generates heat that causes the recording material 5*b* formed opposite the carrier sheet 5*a* to change color. In this case, when a line of images is to be recorded, the thermal head 2 moves in the direction of arrow C as shown in FIG. 1 while the image processing means successively records the images with their left and right sides reversed as shown in FIG. 5 from the actual last image of the line. Upon recording a line of images, the operations to those described above are performed so that the thermal head 2 swings upward and away from the platen 1 in order to return to its original position. In addition, the platen 1 is fed by one line and the above-described operations are repeated in order to further record images. After image recording for one page has been completed, the recording sheet 5 is discharged by the above-described operations such that the protective sheet 5e is at the bottom and the front side 5c of the carrier sheet 5a is at the top.

Accordingly, since the heat from the thermal head 2 is transmitted to the recording material 5b via the carrier sheet 5a, heat is not lost by radiation as it passes through the adhesive 5d as has been conventionally the case when heat is being transmitted from the thermal head 2 to the recording material 5b. Thus, images with sharp edges can be recorded onto the recording material 5b. The images recorded in this way have their left and right sides reversed as shown in FIG. 5 when viewed from the carrier sheet 5a side. Accordingly, when the two-layer thermo-sensitive sheet 5 is turned over so as to reverse the left and right sides of the sheet 5, the protective sheet 5e is peeled away, and the images are viewed from the recording material 5b which is now at the front side, the images appear as normal images as illustrated in FIG. 4.

A description will now be given of another recording method or a fifth recording method in which the two-layer thermo-sensitive recording sheet 5 is used. This method is such as to allow selection of either the normal heating control mode or the vertically inverted image control mode to which the heating control means is switched by the switching means 4. When the protective sheet 5e of the thermo-sensitive recording sheet 5 is disposed in opposition to the thermal head 2 and the switching means 4, the heating control means is selectively switched to the normal heating mode where images are recorded as illustrated in FIG. 4. The other operations are essentially the same as those of the above-described first recording method, so that they will not be described below.

When the thermo-sensitive recording sheet 5 is wound around the platen 1 by means of a sheet feed roller such that the protective sheet 5e contacts the outer peripheral surface of the platen 1, the front side 5c of the carrier sheet 5a is in opposition to the thermal head 2 and the switching means 4, as shown in FIG. 3. In addition, the switching means 4 selectively switches the heating control means to the vertically inverted image heating control mode in order to record images with their top and bottom sides inverted, as illustrated in FIG. 6.

Thereafter, upon generation of a print command from the thermal printer, the thermal head 2 swings downward and toward the platen 1 in order to come into contact with the carrier sheet 5a, and generates heat that changes the color of the recording material 5b formed at the opposite side of the carrier sheet 5a. When image recording in such a case, the thermal head moves in the direction of arrow C as shown in FIG. 1, while the image processing means in the thermal printer successively records the images with their top and bottom sides inverted starting from the actual last line of the page. When recording of the last line of the page is complete, the above-described operations are performed so as to allow the images of the next-to-last line to be recorded.

After the above-described operations have been repeated so that the line to be read first has been recorded, the two-layer thermo-sensitive recording sheet 5 is finally discharged.

The images recorded in such a manner have their top and bottom sides inverted as shown in FIG. 6, when viewed from the carrier sheet 5a side. Therefore, when the two-layer type thermo-sensitive sheet 5 is turned over so as to invert the top and bottom of the sheet 5 and the protective sheet 5e is peeled off, the images appear as normal images as shown in FIG. 4, when viewed from the recording material 5b which is now at the front side.

As in the foregoing description, the heat from the thermal head 2 is transmitted to the recording material 5b without being lost, thus making it possible to produce images with sharp edges on the recording material 5b.

Obviously, the thermal printer may be one having for example a manually-operated switch as switching means 4 in order to perform manual switching between the above-described normal heating control and horizontally-reversed image heating control modes and between normal heating control and vertically-inverted image heating control modes, or having a heating control means provided with three control modes, the normal, horizontally-reversed image, and vertically-inverted image control modes so as to allow switching among these modes, although in the foregoing description the thermal printer described was one having a heating control means that is selectively and automatically switched between the normal heating control mode and the horizontally-reversed image heating control mode, and between the normal heating control mode and the vertically-inverted image heating control mode by the switching means 4.

As can be understood from the foregoing description, according to the present invention, it is not easy for anyone who happens to be in the vicinity of the thermal printer to read the information being recorded because the thermal recording is performed from the carrier sheet 3a side of the thermo-sensitive recording sheet. In addition, anyone who happens to be in the vicinity of the thermal printer cannot easily read the recorded information even after thermal recording because the thermo-sensitive sheet is discharged onto the discharge tray with the recording material side at the bottom.

In addition, according to the present invention, when the thermal printer employs a two-layer type thermo-sensitive recording sheet, thermal recording is performed from the carrier sheet 5a side, so that heat passing through the adhesive bonding the carrier sheet and the protective sheet together will not be lost when it is being transmitted to the recording material from the thermal head. Thus, the present invention is effective in producing high quality images with sharp edges.

Further, according to the present invention, the amount of heat lost by radiation as it passes through the adhesive is negligible compared to the loss of thermal head generated heat in the conventional thermal printer utilizing the two-layer type thermo-sensitive recording sheet, so that the heating temperature of the thermal head does not have to be made high. Therefore, the life of the thermal head can be prolonged, with a low power consumption because only a low heating temperature is required.

Still further, according to the present invention, when thermal recording is to be performed from the carrier sheet 3a side or carrier sheet 5a side, the control mode of the heating control means that controls the heating of the thermal head can be switched between normal heating control mode and horizontally-reversed image heating control modes, and between the normal and vertically-inverted image heating control modes by switching means that selectively switches the heating control means between these modes.

Still further, according to the present invention, it is possible to automatically sense the back side or front side of the thermo-sensitive recording sheet and automatically switch the heating control means of the thermal head, thus saving time for the switching operation.

What is claimed is:

1. A thermal printer of the type using a thermo-sensitive recording sheet prepared by applying a recording material onto a front side of a carrier sheet, with or without an opaque protective sheet bonded thereon, said thermal printer comprising:

a rotatable platen for feeding said thermo-sensitive recording sheet in a first direction; and a carriage mounted adjacent said platen and movable along said platen;

a thermal head pivotally mounted on the carriage;

means for pivoting said thermal head such that said thermal head is pressed against a back side of said carrier sheet; and means for controlling the thermal head to perform thermal recording on said thermo-sensitive recording sheet by inducing a color change in said recording material on the front side of said thermo-sensitive recording sheet, wherein said back side of said carrier sheet is opposite to the front side of said carrier sheet coated with said recording material.

2. A thermal printer according to claim 1, further comprising heat-generation control means for controlling the heat generation of said thermal head in order to perform thermal recording of a normal image, an image whose left and right sides are reversed, or an image whose top and bottom sides are inverted.

3. A thermal printer of the type using a thermo-sensitive recording sheet prepared by applying a recording material onto a front side of a carrier sheet, with or without an opaque protective sheet bonded thereon, said thermal printer comprising:

a rotatable platen for feeding said thermo-sensitive recording sheet in a first direction; and a carriage mounted adjacent said platen and movable along said platen;

a thermal head pivotally mounted on the carriage;

heat-generation control means for controlling, in accordance with a heating control mode, the heat generation of said thermal head in order to perform thermal recording of a normal image, an image whose left and right sides are reversed, or an image whose top and bottom sides are inverted on said thermo-sensitive sheet;

heating mode control means for switching the heating control mode to one of a normal image heating control mode, a horizontally-reversed image heating control mode in which an image is recorded with its left and right sides reversed, or a vertically-inverted image heating control mode in which an image is recorded with its top and bottom sides are inverted; and means for pressing said thermal head against one of the side of said thermo-sensitive recording sheet coated with said recording material, the protective sheet side of said thermo-sensitive recording sheet, and a back side of said carrier sheet which is opposite said front side in order to perform thermal recording of a normal image, an image whose left and right sides are reversed, or an image whose top and bottom sides are inverted and appears on the front side of the thermo-sensitive recording sheet by inducing a color change in said recording material.

4. A thermal printer according to claim 3, comprising automatic selecting means for automatically switching said heat-generation control means of said thermal head by automatically identifying the recording material side of said thermo-sensitive recording sheet, the protective sheet side of said thermo-sensitive recording sheet, or the back side of said carrier sheet.

5. A method for printing onto a thermo-sensitive recording sheet, the thermo-sensitive recording sheet being prepared by applying a recording material onto a front side of a carrier sheet, the method comprising the steps of:

feeding the thermo-sensitive recording sheet using a rotatable platen such that the front side of the thermo-sensitive sensitive recording sheet contacts a surface of the rotatable platen; and driving a carriage mounted adjacent the platen such that the carriage moves along the platen;

pivoting a thermal head mounted on the carriage such that the thermal head contacts a back side of the thermo-sensitive recording sheet, the back side of the carrier sheet being opposite to the front side of the carrier sheet; and controlling the thermal head to perform thermal recording on the thermo-sensitive recording sheet by inducing a color change in the recording material such that the thermal recording is visible only on the front side of the thermo-sensitive recording sheet.

* * * * *

UNITED STATES PATENT AND TRADEMARK OFFICE

CERTIFICATE OF CORRECTION

PATENT NO. : 5,690,436

DATED : November 25, 1997

INVENTOR(S) : Katsutoshi Suzuki et al.

It is certified that error appears in the above-indentified patent and that said Letters Patent is hereby corrected as shown below:

In Claim 3, line 24, delete "are".

In Claim 5, line 7, delete the second occurrence of "sensitive".

Signed and Sealed this

Fifteenth Day of December, 1998

Bruce Lehman

*Attest:*

BRUCE LEHMAN

*Attesting Officer*

*Commissioner of Patents and Trademarks*